US007082899B2

(12) United States Patent
Hanson et al.

(10) Patent No.: US 7,082,899 B2
(45) Date of Patent: Aug. 1, 2006

(54) CONTROLLED STARTING AND BRAKING OF AN INTERNAL COMBUSTION ENGINE

(75) Inventors: David E. Hanson, Upton, MA (US); Jun Ma, Auburn, MA (US); Benjamin G. K. Peterson, West Boylston, MA (US); Geoffrey C. Chick, Norfolk, MA (US)

(73) Assignee: Bose Corporation, Framingham, MA (US)

( * ) Notice: Subject to any disclaimer, the term of this patent is extended or adjusted under 35 U.S.C. 154(b) by 2 days.

(21) Appl. No.: 10/810,930

(22) Filed: Mar. 26, 2004

(65) Prior Publication Data

US 2005/0211194 A1 Sep. 29, 2005

(51) Int. Cl.
*F02D 27/00* (2006.01)
*F02D 43/00* (2006.01)
*F02N 17/00* (2006.01)

(52) U.S. Cl. ..... 123/41 E; 123/179.5

(58) Field of Classification Search ..... None
See application file for complete search history.

(56) References Cited

U.S. PATENT DOCUMENTS 1,676,591 A 7/1928 Weller
4,009,695 A 3/1977 Ule
4,364,336 A 12/1982 Skala
4,462,348 A 7/1984 Giardini
5,036,802 A 8/1991 D'Amours
5,074,263 A 12/1991 Emerson
5,687,682 A 11/1997 Rembold et al.
6,098,585 A 8/2000 Brehob et al.
6,125,808 A 10/2000 Timewell
6,237,546 B1 5/2001 Gander
6,588,397 B1 * 7/2003 Sieber ..... 123/179.5
6,799,547 B1 * 10/2004 Sieber ..... 123/179.5
2002/0166531 A1 * 11/2002 Ackermann et al. ... 123/179.16

FOREIGN PATENT DOCUMENTS

WO WO 93/04278 3/1993

* cited by examiner

*Primary Examiner*—Andrew M. Dolinar
(74) *Attorney, Agent, or Firm*—Fish & Richardson P.C.

(57) ABSTRACT

An internal combustion engine may be provided with independently controllable valves, fuel injectors and ignition elements that may be used to start the engine without a separate auxiliary device such as an electric starter motor. The engine may fire the cylinders under a startup mode of control at the same time it fires the cylinders under a normal mode of control in order to smooth the transition from start up to normal operating mode. Additionally, an internal combustion engine may use independently controllable valves to stop the engine and ensure that one or more of the pistons come to rest at a position which allows them to be used to restart the engine.

21 Claims, 9 Drawing Sheets

CONTROLLED STARTING AND BRAKING OF AN INTERNAL COMBUSTION ENGINE

TECHNICAL FIELD

This disclosure relates to internal combustion engines, and more particularly to starting and stopping such engines.

BACKGROUND

In a conventional internal combustion engine, either a reciprocating-type engine or a rotary-type engine, a separate auxiliary device such as a starter motor and large battery are often provided in order to start the engine. In such an engine, the starter motor draws power from the battery in order to turn a flywheel, which, in turn, rotates the engine's crankshaft. In a four-stroke engine, a starter motor must provide sufficient power to rotate the crankshaft enough to complete a compression stroke. Once a compression stroke is completed, the engine fires the compressed charge and thus begins normal engine operation.

When an internal combustion engine is turned off by an operator (e.g., a key switch is disengaged or a choke valve is closed), the engine stops by stopping the combustion in its chambers by simply ceasing the delivery fuel and/or air to the combustion chambers. With no combustion in the chambers, the crankshaft stops rotating and the engine stops. In such an engine, however, there is no control over where the crankshaft (and thus also the pistons) come to rest.

SUMMARY

In one aspect, the invention features a method of starting an internal combustion engine that includes selecting a cylinder for initial firing based upon the piston of the cylinder being located in a predetermined position along its stroke, injecting fuel into the selected cylinder to create an uncompressed fuel-air mixture, and igniting the uncompressed fuel-air mixture in the selected cylinder. Cylinders are subsequently selected for firing as a function of cylinder piston position without regard to normal firing order, injected with fuel to create an uncompressed fuel-air mixture and fired until at least there is sufficient kinetic energy to complete a compression stroke in at least one of the cylinders. After completion of a compression stroke, cylinders are fired according to the predefined normal firing order.

Various embodiments may include one or more of the following features.

The method may also, prior to firing the cylinders according to their normal firing order, adjust a dynamic compression ratio of a selected cylinder by adjusting valve event parameters (e.g., valve lift and timing) of the cylinder.

The predetermined position of the cylinder selected for initial firing may be a position where the piston has sufficient mechanical advantage to rotate the crankshaft (in either a counter-clockwise or clockwise direction) through at least 180 degrees in response to igniting the mixture in the first selected cylinder. The predetermined piston position of the cylinder selected for initial firing may be in range between 25 and 155 crankshaft degrees after top dead center.

Before igniting the uncompressed fuel-air mixture in a selected cylinder, an intake valve may be opened (and later closed) to introduce a fresh charge into the selected cylinder. After igniting the cylinder selected for initial firing, an exhaust valve may be closed when piston moves away from bottom dead center toward top dead center. The exhaust valve may remain open until the piston reaches approximately top dead center.

The method may further include selecting multiple cylinders for initial firing, wherein the selection of each cylinder is based upon the piston of the respective cylinder being located in a predetermined position along its stroke. The method may also include closing an intake and/or exhaust valve prior to firing the cylinder(s) selected for initial firing.

The fuel may be injected by way of a fuel injector and may be injected such that it forms a combustible mixture with a fuel/air ratio approximately stoichiometric. The process of selecting, igniting and firing cylinders based on cylinder piston position without regard to normal firing order may occur while the cylinders are fired according to the predefined normal firing order, which helps to smooth the transition from the start up mode to the engine's normal firing order.

In another aspect, the invention features a method of reducing the speed of an internal combustion by determining a first speed of the engine, estimating an amount of pumping work sufficient to reduce the speed of the engine to a second speed, and actuating one or more valves associated with one or more of the engine's cylinders to produce at least part of the estimated amount of pumping work within the engine.

Various embodiments may include one or more of the following features.

The first speed may be within range of predetermined speeds for which it has been determined that the engine may be stopped in one braking stroke using pumping work such that the crankshaft will stop within a desired range of crankshaft angles, and pumping work may be applied to stop the engine within the desired range. The method may also reduce the speed of the engine to a speed for which it has been determined that the engine may be stopped in one braking stroke using pumping work such that the crankshaft will stop within a desired range of crankshaft angles. The desired range may be a position where the piston has a mechanical advantage to rotate the crankshaft through bottom dead center (e.g., between 25 and 155 crankshaft degrees). The pumping work may be generated by actuating intake and/or exhaust valves in the cylinder, and valve actuation may be such that intake and exhaust valves open and close simultaneously or are sequenced such that the cylinder is adequately scavenged (e.g. by opening an intake valve before opening the exhaust valve to draw in a fresh charge through the intake valve, and closing the intake valve before closing the exhaust valve to expel combustion residue through the exhaust valve).

A desired amount of pumping work may be achieved by determining the position of the piston within a cylinder, opening the valve when the piston is at a first position and closing the valve when the piston is at a second position, wherein the first and second positions depend upon the entering speed of the engine.

The method may also involve determining the number of piston strokes sufficient to reduce the speed of the engine from the first speed to the second speed and determining an amount of pumping work required for each determined number of strokes to reduce the speed of the engine from the first speed to the second speed.

The method may also include determining various valve event parameters, such as valve timing, lift and sequence, to produce the estimated amount of pumping work. The valve event parameters may be dynamically determined (i.e., determined in real time) or may be determined by accessing pre-stored data.

The method may also include estimating an amount of friction work in one or more of the cylinders of the engine, and may use the estimated amount of friction work to determine the estimated amount of pumping work.

Another aspect of the invention features a method of stopping an internal combustion engine that includes determining a range of speeds in which the engine may be stopped in one braking stroke using pumping work such that the crankshaft will stop within a desired range of crankshaft angles and actuating the valve actuation system to produce pumping work in the cylinders to stop the engine in one braking stroke when the engine's speed has reached a target speed that is within the determined range of speeds.

Various embodiments may include one or more of the following features.

The determination of a range of speeds for which the engine may be stopped in one braking stroke such that the crankshaft will stop within the desired range may be predetermined through simulation or actual engine testing. The desired range of crankshaft angles is a range of positions where at least one piston has sufficient mechanical leverage to rotate the crankshaft in a clockwise or counter-clockwise direction.

Prior to actuating the valve actuation system to stop the engine, an amount of pumping work and number of strokes required to reduced the speed of the engine from a first speed to the target speed may be determined. The method may actuate the valve actuation system to produce the estimated pumping work required to reduce the speed of the engine from a first speed to the target speed and may distribute the estimated pumping work evenly among several of strokes to reduce the entering speed to the target speed. After the engine has stopped, a valve may be actuated to use pressure energy from stored fluid in a cylinder (e.g., compressed or vacuumed air) to adjust the final crankshaft angle of the engine.

The method may also estimate an amount of friction work in one or more of the cylinders. One way to estimate the friction work is to predict a residual speed of the engine prior to actuating the valve actuation system and then compare the actual residual speed to the predicted residual speed after valve actuator. Another way to estimate the friction work is to apply a minimum amount of pumping work to a cylinder in a stroke and sample the engine speed during the stroke and then estimating the amount of friction work based on the change in engine speed during the stroke.

Another aspect of the invention features an internal combustion engine that includes a cylinder housing a piston attached to a crankshaft, an intake valve and actuator that controls the intake of air into the cylinder, an exhaust valve and actuator that controls the expulsion of air from the cylinder, and a valve control module that, upon receiving a command to stop the engine, adaptively controls the intake valve actuator and exhaust valve actuator to produce pumping work to stop the engine such that the crankshaft will stop within a desired range of crankshaft angles.

Various embodiments may include one or more of the following features.

The valve control module may be configured to, upon receiving a command to stop the engine, adaptively control the intake and/or exhaust valve actuators to produce pumping work to reduce the engine from a first speed to a second speed, wherein the second speed is within a predetermined range of speeds for which it has been determined that the engine may be stopped in one braking stroke using pumping work such that the crankshaft will stop within a desired range of crankshaft angles.

The engine may also include an ignition element disposed at least partially within the cylinder that ignites fuel within the cylinder, a fuel injection element disposed at least partially within the cylinder that injects a suitable amount of fuel into the cylinder, and an ignition and fuel injection control module that stops the injection and ignition of fuel upon receiving a command to stop the engine.

In another aspect, the invention features an internal combustion engine that includes a cylinder housing a piston attached to a crankshaft, an intake valve and actuator that controls the intake of air into the cylinder, an exhaust valve and actuator that controls the expulsion of air from the cylinder, and a starting module that identifies one or more cylinders with pistons in a predetermined position range, selects the identified cylinders independently of their normal operating stroke cycles, and fires the identified cylinders.

In another aspect, the invention features a method of starting a four-stroke internal combustion engine from rest that includes operating a first number of cylinders in a two-stroke cycle that does not compress fuel-air mixture prior to combustion and, after sufficient kinetic energy has accumulated in the engine to complete a compression stroke, then operating simultaneously a second number of the plurality of cylinders in a normal four-stroke cycle.

Various embodiments may include one or more of the following features. Operation of the cylinders in the two-stroke cycle may cease while operation of the cylinders in a normal four-stroke cycle continues. The first stroke of the two-stroke cycle may introduce a fresh charge into the chamber and the second stroke may release combustion residue.

Other various aspects of the present invention involve independently controlling the valves, fuel injectors, and/or ignition sources of the combustion chambers of an engine in order to start the engine without the assistance of a starter motor. Another aspect involves starting an engine rotating in a reversed direction, to eliminate a reverse gear. An additional aspect involves stopping the rotation of an engine such that one or more of the pistons come to rest at a desirable location or range of locations within a cylinder, where a desirable location is one where the piston would have sufficient mechanical leverage to restart the engine if combustion of fuel in the cylinder were initiated.

One advantage of an engine designed in accordance with various teachings of this disclosure is that such an engine may be started without the assistance of a separate starter motor and large, high-powered battery.

Another advantage of such an engine is that a reverse gear may be eliminated.

Another advantage of such an engine is that the engine may be stopped rather than idled when at rest, thus reducing emissions and fuel consumption.

Another advantage of such an engine is that the engine may be stopped in order to ensure that one or more of the engine's piston are positioned in a location that provide sufficient mechanical leverage to rotate the crankshaft when the engine is restarted.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1B:
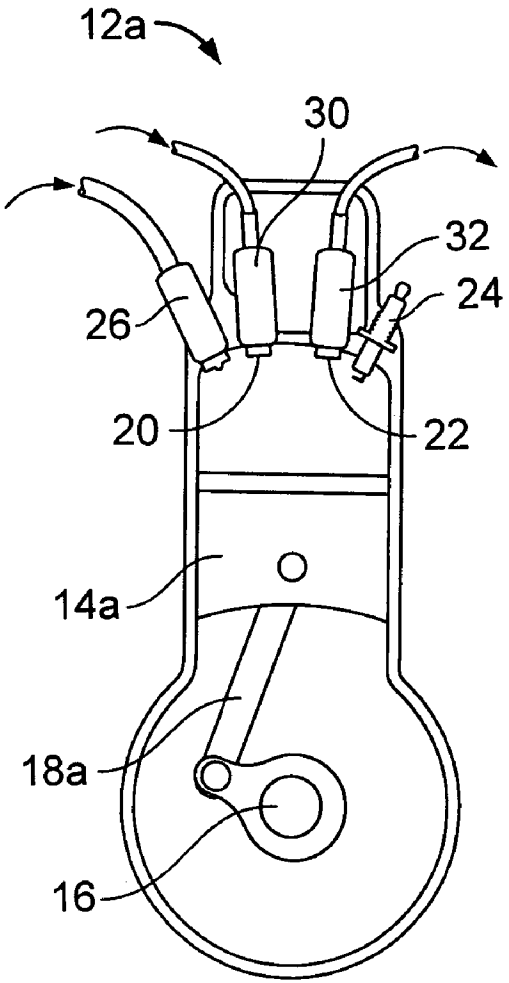
FIG. 1B shows one cylinder of the eight-cylinder internal combustion engine shown in FIG. 1A.
Figure 1A:
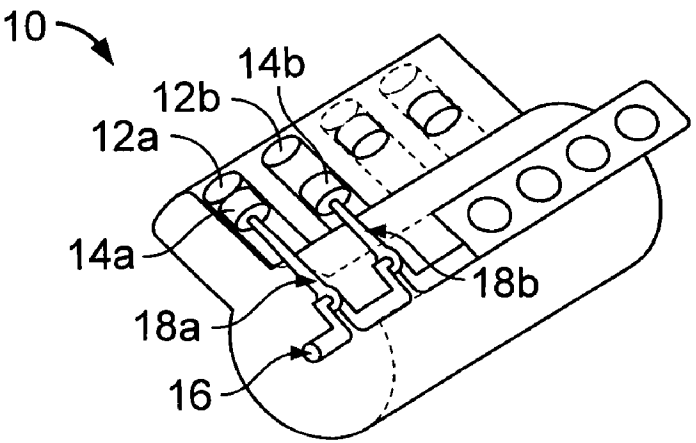
FIG. 1A shows an eight-cylinder internal combustion engine equipped with an independent valve actuation mechanism, a programmable fuel injection system and programmable ignition system.

As shown in FIG. 1A, an internal combustion engine 10 includes 8 cylinders, e.g., 12*a*–12*b*, that each houses a piston, e.g., 14*a*–14*b*. Each of the pistons, in turn, is mechanically connected to crankshaft 16 with a rod, e.g., 18*a*–18*b*. It should be noted that while the engine depicted in FIG. 1A is a V8 engine, various features described below are not limited to a V8 engine, but may be applied to any internal combustion engine, such as an inline engine or a flat engine, with any number of cylinders.

Each cylinder, e.g., 12*a*, as shown in FIG. 1B, includes an intake valve 20, exhaust valve 22, spark plug 24, and fuel injector element 26 each disposed at least partially within the cylinder. For simplicity, only one intake and one exhaust valve are shown for a cylinder, however, there may be more than one intake and/or exhaust valve for each cylinder in other embodiments. A control unit (not shown) individually and variably controls the operation of the spark plug 24 and fuel injector 26 which delivers fuel into the cylinder chamber for each cylinder. The control unit also independently and variably controls the intake and exhaust valves 20, 22 by controlling valve actuator mechanisms 30, 32 to vary valve event parameters. The valve event parameters include the valve lift (i.e., the amount the valve is open) and valve timing (i.e., the opening and closing points of the intake and exhaust valves with respect to the crankshaft position). The intake and exhaust valves 20, 22 may employ a variety of valve actuator mechanisms such as hydraulic, pneumatic, electromagnetic or piezo-electrical, or any other actuation mechanism known in the art. For example, co-pending U.S. patent application entitled "Electromagnetic Actuator and Control" by Thomas A Froeschle, Roger Mark, Thomas C. Schroeder, Richard Tucker Carlmark, Dave Hanson, and Jun Ma, filed concurrently with this application, which is incorporated by reference, describes an integrated valve and actuator mechanism for controlling flow in and out of a cylinder that could be used as the intake valve and actuator 20, 30 and exhaust valve and actuator 22, 32 in engine 10.

As will be explained in more detail below, the control unit controls functional elements associated with each of the engine's cylinders, 12*a*, 12*b*, (i.e. valves, fuel injectors, ignition sources, etc.) to start the engine without the assistance of an auxiliary motor (e.g., a starter motor) and transition the engine from operating in a start-up mode to operating in a normal operating mode. Thus, engine 10 is configured to operate in at least two modes, a start-up mode and a normal operating mode.

Figure 2B:
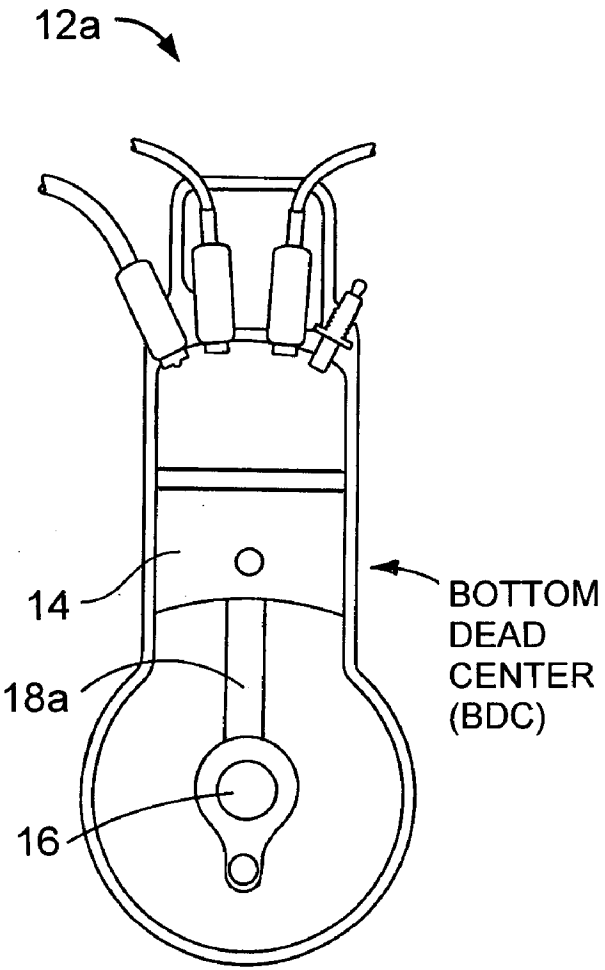
FIG. 2B shows the bottom-dead-center (BDC) piston location.
Figure 2A:
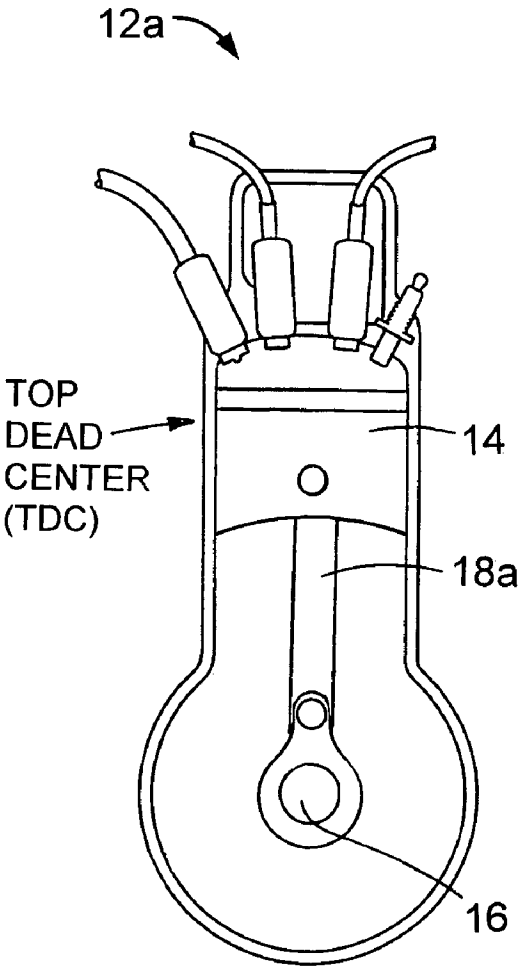
FIG. 2A shows the top-dead center (TDC) piston location.

In the normal operating mode, all cylinders operate in a normal multi-stroke cycle such as a conventional four-stroke cycle, with intake, compression, combustion and expansion, and exhaust strokes. A stroke occurs when a piston moves either from its top-dead center (TDC) position to its bottom-dead-center (BDC) position or from its BDC to its TDC, which are illustrated in FIGS. 2A–2B. As the pistons move up and down in the cylinders, they rotate the crankshaft 16. The exemplary engine 10 is configured such that the crankshaft 16 completes a revolution every two strokes. Thus each stroke is said to be 180 crank angle (CA) degrees in length.

In the start-up mode, at least one cylinder operates in a two-stroke cycle having an (i) intake, combustion and expansion stroke and a (ii) exhaust stroke. The intake, combustion and expansion stroke, happens when a cylinder piston moves from TDC to BDC. During this stroke, the cylinder's intake valve opens at a certain advance angle prior to TDC to introduce fresh charge into the cylinder. The intake valve closes when the piston moves away from TDC, for example, when the piston moves a little less than half stroke. The fuel injector then injects certain amount of fuel which can form a combustible mixture with a fuel/air ratio close to stoichiometric ratio with entrapped fresh air. Simultaneously, the spark plug ignites the combustible mixture which pushes the piston down to its BDC position. In this combustion process, the generated kinetic energy is stored in the engine's piston-connecting-rod-crankshaft mechanism. The second stroke of the two-stroke cycle, namely the exhaust stroke, happens as the piston moves from its BDC to TDC immediately after the first stroke. The exhaust valve of the cylinder opens at a certain advanced angle just prior to BDC and stays open until the piston reaches its TDC (plus a certain valve close delay angle). During this second stroke, the combustion residue is released and expelled to the emission system.

In order for a cylinder to be able to conduct the first stroke of this two-stroke cycle, a cylinder should have its piston in a position within a range of positions where the piston has sufficient mechanical advantage to rotate the crankshaft. In this description, the position where a piston has sufficient mechanical advantage to rotate the crankshaft is represented as a crank angle degrees after TDC. Another benefit of having the piston at a crank angle degrees after its TDC is that the cylinder should have a fresh charge already entrapped in the cylinder, and thus fuel may be immediately injected into the cylinder for combustion. Because the piston is at an angle $\alpha$ prior to the beginning of the start up mode, the first stroke of the start up mode must rotate the crankshaft through (180-$\alpha$) degrees crank angle to reach BDC.

The desired range of angle $\alpha$ is primarily determined by the geometric ratio between the length of the connecting-rod and the radii of the crankshaft, however, it is also influenced by the friction characteristics between the piston and the cylinder wall. In an V8 351 spark ignition engine, the angle $\alpha$ is within the range of approximately 25° CA to 155° CA after TDC, and is preferably 76° CA after TDC.

During the start-up mode, the cylinders (which may be some or all of the engine's cylinders) operate in a special two-stroke cycle to accumulate sufficient kinetic energy to transition the engine into its normal four-stroke cycle (i.e., the engine's normal operating mode). After the piston-connecting-rod-crankshaft mechanism of the engine accumulates sufficient kinetic energy for at least one cylinder to operate in a normal four-stroke cycle successfully, the engine can start its transition from the special two-stroke cycle to the normal four-stroke cycle. Since the special two-stroke cycle of the start up mode does not compress the fuel-air mixture before combustion, it has low thermodynamic efficiency. Accordingly, it is preferable to transition from the start up mode to the normal four cycle mode as quickly as possible.

As the engine transitions from its start up mode to its normal mode, the cylinders are preferably controlled such that some cylinders continue to operate in the two-stroke cycle of the start up mode while other cylinders operate in the normal four-stroke cycle for several strokes. Overlapping of the two-stroke cycle and the normal four-stroke cycle for several strokes helps to make a smooth transition between the two operating modes.

Figure 2C:
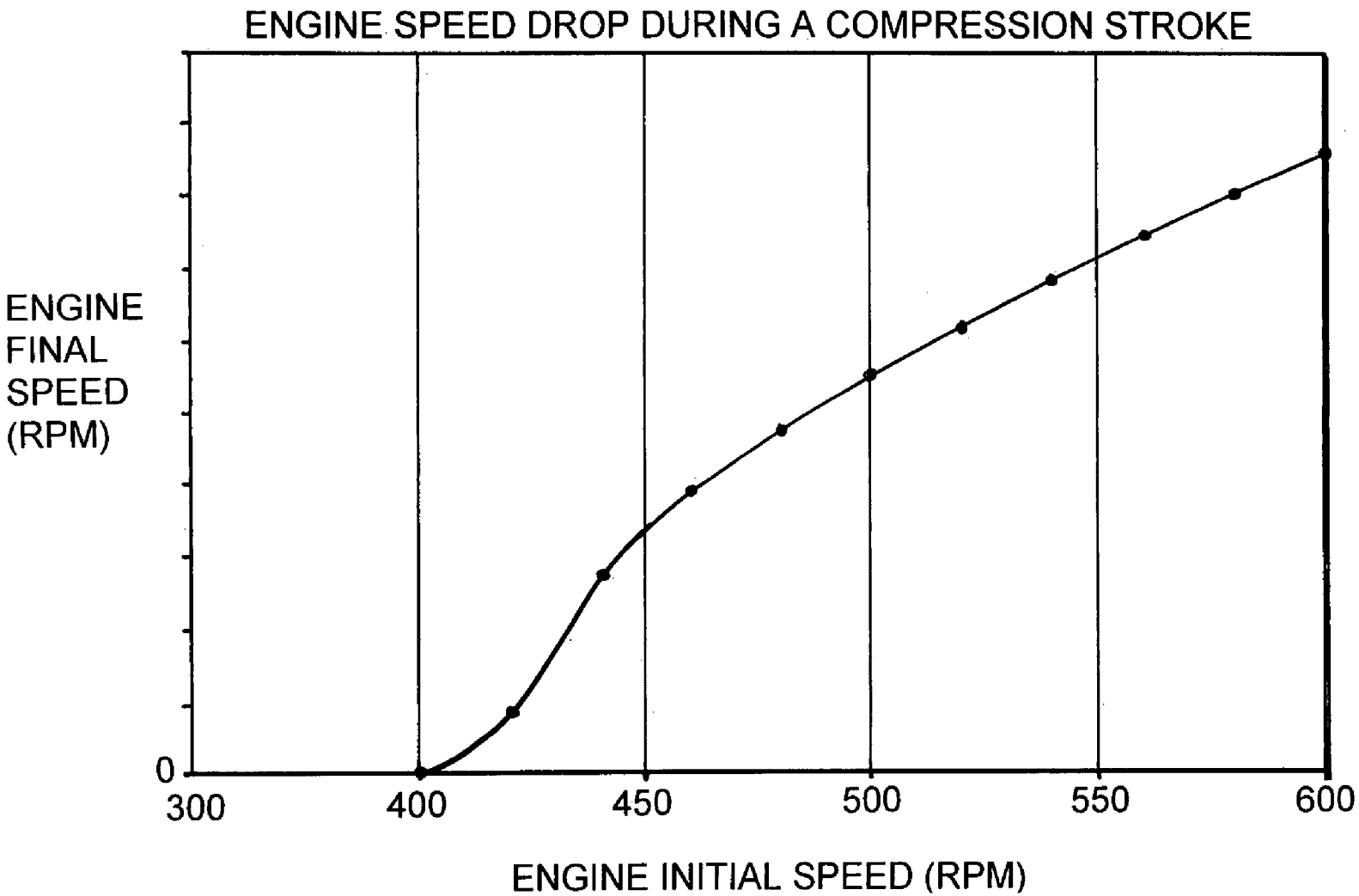
FIG. 2C shows the engine initial speed before a compression stroke vs. engine final speed after the compression stroke for the exemplary V8 engine.

Since engine speed is easy to measure and is directly related to the amount of kinetic energy in the engine, a preferred embodiment monitors the engine's speed during start up mode to determine when there is sufficient kinetic energy to transition to the normal operating mode. The engine speed (which again is a proxy for the engine's kinetic energy) necessary to begin a compression stroke may be predetermined for a particular engine through simulation or experiment. For example, as shown in FIG. 2C, a final speed of an exemplary V8 351 spark ignition engine (i.e., the speed of the engine after the completion of a compression stroke) drops to a non-zero value during a compression stroke at any point where the engine has an initial speed of 400 rpm or higher. In other words, the engine will stall if a compression stroke is attempted before the engine has reached a minimum speed of 400 rpm. Thus, this engine requires an initial speed of at least 400 rpm before it can successfully finish a full power compression stroke.

The energy needed for a compression stroke may also be determined by the effective compression ratio (or dynamic compression ratio) of the stroke, which can be adjusted by adjusting valve event parameters. For example, an early intake valve close (EIVC) or a late intake valve close (LIVC) strategy, as known in the art, can be used to decrease the effective compression ratio of the compression stroke, which also decreases the threshold kinetic energy (i.e., the minimum amount of the kinetic energy needed to ensure at least one cylinder can complete a compression stroke and initiate its follow-up combustion stroke).

In the normal operating mode, engine 10 fires the cylinders in a conventional firing order for a V8 engine (e.g., 1-8-4-3-6-5-7-2) at the appropriate firing interval. The firing interval for an engine is the number of strokes multiplied by the crank angle per stroke and divided by the number of cylinders. Thus, for the V8 engine shown in FIG. 1A, the firing interval occurs every 90 crank angle degrees (i.e., 4 strokes×180 degrees÷8 cylinders=90 CA degrees). In the startup mode, since any cylinders, that have pistons falling approximately within the range of 25° CA and 155° CA after its TDC (where the piston has sufficient mechanical advantage to push the crankshaft to rotate), can be chosen to participate in the start-up process, the firing order can be variable. The variable firing order for the cylinders operating in the special two-stroke cycle may be much different from the normal firing order.

Figure 3:
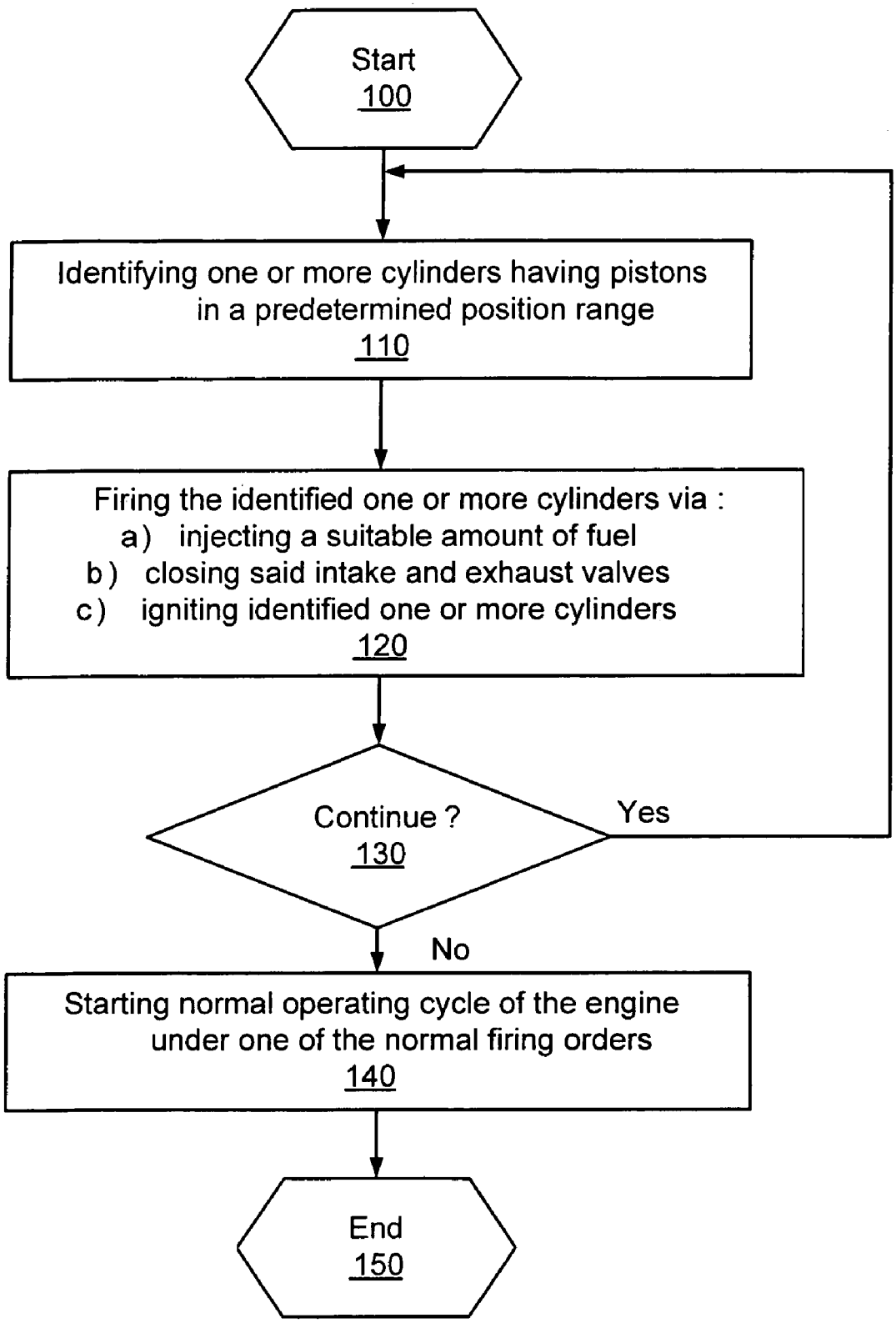
FIG. 3 is a flow chart illustrating a self-starting process.

A flow chart illustrating the start-up operating mode of engine 10 (shown in FIG. 1) is shown in FIG. 3.

The start-up operating mode begins when the control unit receives a signal to start the engine (100). After receiving a signal to start the engine, the control unit selects one or more cylinders in which to begin the starting process. The control unit selects cylinder(s) that have pistons positioned in a predetermined range relative to top dead center (TDC) (110). In this embodiment, the predetermined range is where the piston has sufficient mechanical advantage to rotate the crankshaft, which is approximately 25°–155° crankshaft angle (CA) degrees after TDC, with the preferred position at about 76° CA degrees after TDC. If multiple cylinders have pistons in the predetermined range, some or all may be used as start-up process participating cylinders to expedite the starting process. The piston position information can be identified (110) by any known technique, such as by using a position encoder to track the current crankshaft angle.

After selecting the cylinder(s) to fire, the control unit fires the selected cylinders (120) by closing the intake and exhaust valve(s), injecting a suitable amount of fuel via the fuel injector 26 (shown in FIG. 1B), and igniting the identified cylinder(s) via the spark plug 24. It should be noted that there should be a fresh charge of air present within the selected cylinders because when the engine is shut down, a controlled engine braking process (described below) ensures that at least one cylinder with a fresh charge is located in the predetermined crankshaft angle range. It also should be noted that a variety of fuel injection mechanisms, which can inject certain amount of fuel into the chamber to form a combustible mixture with a fuel/air ratio close to stoichiometric ratio with the entrapped fresh air, can be employed.

The initial participating firing cylinders should produce sufficient kinetic energy to rotate the crankshaft such that one or more pistons in other cylinders are moved within the predetermined range, which allows them to participate in the starting process. Note that in the initial start-up mode, the valve event parameters of the initial firing cylinder(s) are controlled such that the initial firing cylinder(s) do not follow a normal four-stroke cycle, but instead follow the start-up two stroke cycle. Engine 10 does not compress the fuel-air mixture before combustion for the initial firing cylinder(s).

After the initial firing of the selected cylinders, the control unit determines whether there is sufficient kinetic energy (as described earlier) in the piston-connecting-rod-crankshaft mechanism, to complete a compression stroke (130). If there is not, then the control unit repeats the steps of selecting cylinders with pistons that are within a predetermined crankshaft angle range and firing those cylinders (110, 120).

Once there is sufficient kinetic energy in the cylinders to complete a compression stroke, the control unit starts transitioning the engine to a normal mode of operation (140). During the transition from the startup mode to normal mode, the control unit operates some cylinder(s) under a normal four-stroke cycle and some cylinder(s) under the special startup two-stroke cycle. By doing so, the engine 10 makes a smooth transition from the start-up mode to the normal operating mode. The starting process ends anytime after the normal operation cycle is completely underway (150).

Engine 10 may also be started in reverse by selecting cylinders with pistons positioned in a predetermined range relative to top-dead center such that the selected cylinders have sufficient mechanical advantage to turn the crankshaft in a counter-clockwise direction (e.g., for example 25°–155° CA degrees before TDC), and then firing the cylinders in the reverse of their normal firing order after the engine is started by turning the crankshaft in a clockwise direction. Thus, a control unit may be configured to start an engine in either forward or reverse by firing the cylinders such that the piston-connecting-rod-crankshaft assemblies rotate the crankshaft clockwise (i.e., forward) or counter-clockwise (i.e., reverse). By enabling the control unit to start the engine in forward or reverse, a reverse gear may be eliminated. When the control unit receives a command to reverse the engine, it may first make a controlled stop of the engine (as will be described in more detail below) such that at least one piston is positioned in the predetermined range for providing sufficient mechanical leverage to rotate the crankshaft in a counter-clockwise direction, and then self-start the engine according to the process described above.

Figure 4:
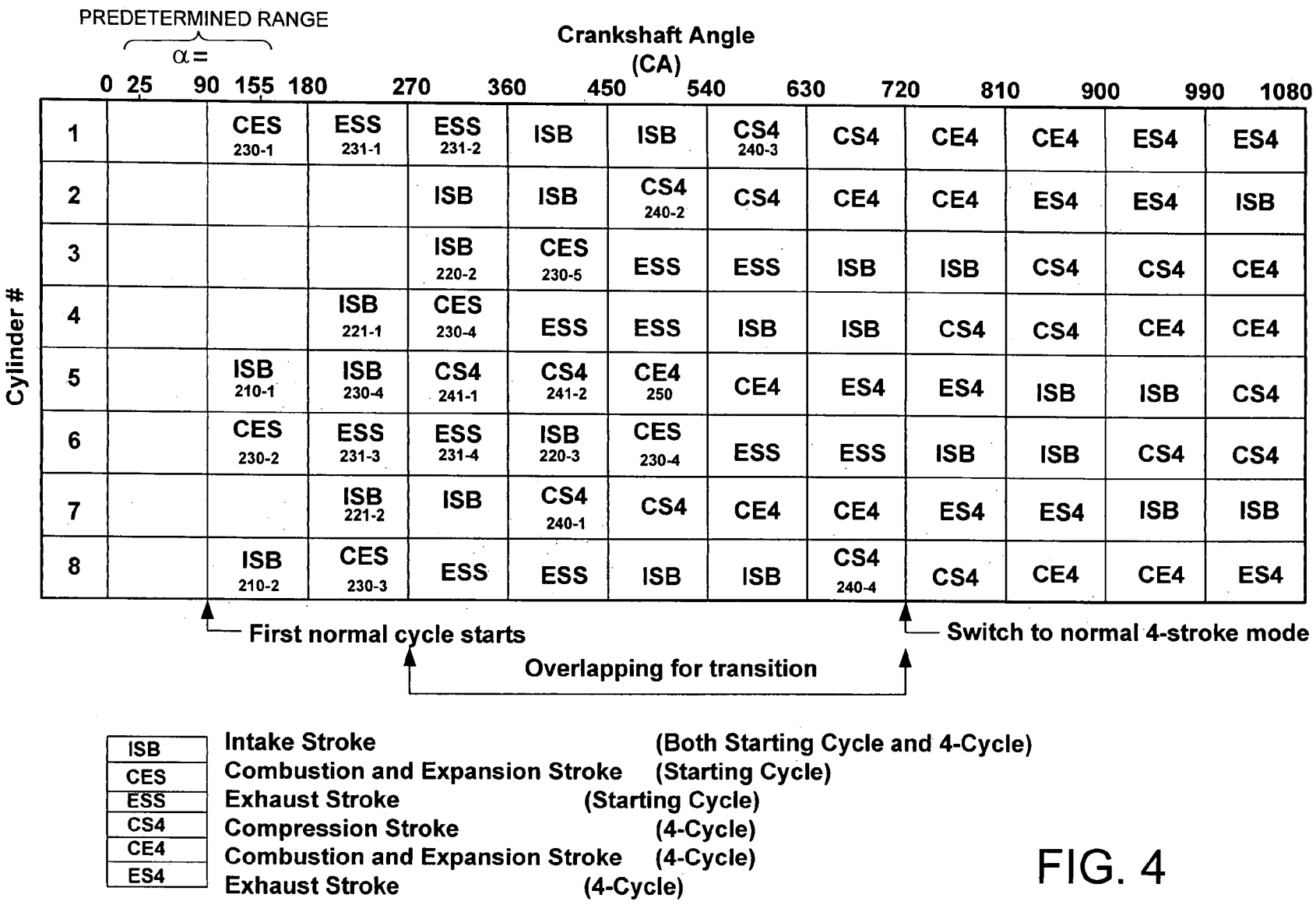
FIG. 4 is chart illustrating the starting process for a 351 cubic inch V8 spark ignition engine operating in a four-stroke cycle.

FIG. 4 illustrates the startup process of a 351 cubic inch V8 spark ignition four-stroke cycle engine having a conventional forward gear firing order of 1-8-4-3-6-5-7-2 and required one or more pistons to be within a predetermined crankshaft angle range of 25–155 CA degrees after TDC. When a control unit (not shown) receives a signal to start the motor, it begins to operate the engine in a start-up mode. At the beginning of the start-up mode, the control unit identifies cylinders 1 and 6 as being at 90 CA degrees, which is within a predetermined crankshaft angle range of 25–155 CA degrees after TDC and selects these two cylinders for firing. Thus, in this example, a equals 90 CA degrees. However, it should be understood that the selected cylinders can be at any angle within the predetermined range. It should be noted that the very first stroke for cylinders 1 and 6 (200-1, 200-1) does not start from TDC, but from a predetermined position ($\alpha$ crank angle degrees) that falls within the predetermined range of acceptable positions. The next stroke of the start up cycle begins when one or more pistons move to TDC and thus the very first stroke should produce sufficient kinetic energy to rotate the crankshaft such that at least one piston moves to TDC. Since cylinders 1 and 6 are at 90 crank angle degrees, they must rotate the crankshaft 90 CA degrees in order to move cylinder 5 into place. It should also be understood that cylinders 1 and 6 have a fresh charge that was entrapped by a scavenging process (described more below) prior to the engine being stopped and thus do not require an intake stroke to draw a fresh charge.

After selecting cylinders 1 and 6 for firing, the control unit injects a suitable amount of fuel to each of the cylinders 1 and 6, and ignites the spark plug to fire the cylinders. Cylinders 1 and 6 thus start the startup combustion and expansion strokes (CES) (230-1, 230-2), without pre-compression, and the kinetic energy generated will push the piston and cause the crankshaft to rotate. As discussed before, it only takes about 90° (180°-$\alpha$) crank angle for cylinder 1 and 6 to complete the first stroke of their very first special two-stroke cycle.

The exhaust valves of cylinders 1 and 6 open as soon as the pistons of the cylinders 1 and 6 are pushed to their respective bottom-dead-centers (BDC). It takes about 180 crank angle degrees for cylinders 1 and 6 to complete their startup exhaust processes, until their pistons are pushed back to their respective TDC (231-1, 231-2, 231-3, 231-4). Note that cylinders 1 and 6 can both be used to initiate the starting process simultaneously because their valves are controlled independently of crankshaft position.

During the combustion and expansion stroke of cylinders 1 and 6 (230-1, 230-2), the intake valves of cylinders 5 and 8 stay open to suck fresh charge from the intake manifold (210-1, 210-2). After the crankshaft has rotated to a position where cylinders 5 and 8 have a sufficient mechanical advantage angle to push the crankshaft (note that for simplicity, FIG. 4 shows crankshaft rotation of about 90 degrees), the control unit then closes the intake valve of cylinder 8, injects a suitable amount of fuel into cylinder 8, and ignites the fuel air mixture to fire cylinder 8 (230-3). Note that cylinder 5 could have been fired instead of or in addition to cylinder 8. Instead, in this embodiment, cylinder 5 continues its normal intake stroke until its piston moves down to its BDC (230-4). The fully charged cylinder 5 will be compressed in its follow-up stroke (CS4, 241-1, 241-2), which will become the first normal combustion stroke (CE4, 250).

Because the special two-stroke cycle does not compress the fuel-air mixture is has a lower thermodynamic efficiency than a conventional four-stroke cycle in which the fuel-air mixture is compressed. Accordingly, it is generally preferable to start the transition process as soon as it is determined that the piston-connecting-rod-crankshaft mechanism of the engine can provide sufficient kinetic energy for a cylinder (cylinder 5 in this example) to operate in a normal four-stroke cycle successfully. In some situations, such as in a cold weather environment, the engine may be more difficult to start and the control unit may need to build up more kinetic energy than normally would be required in a warmer environment to complete a single compression stroke.

Referring again to FIG. 4, when cylinder 8 is combusting and expanding at its startup cycle (230-3), it adds more kinetic energy to the piston-connecting-rod-crankshaft mechanism. At the same time, the control unit begins a startup intake stroke in cylinder 4 (221-1) and an intake stroke in cylinder 7 (221-2). The combustion and expansion stroke (CES) of cylinder 8 (230-3) is followed by the startup combustion and expansion stroke (CES) of cylinder 4 (230-4), which is further followed by the startup combustion and expansion process (CES) of cylinder 3 (230-5), which is further followed by the startup combustion/expansion process (CES) of cylinder 6 (230-6). All these startup combustion/expansion strokes (CES) add more and more kinetic energy to the piston-connecting-rod-crankshaft mechanism, and help transition the engine from start-up mode to normal four-stroke cycle operation mode.

At about 270 degrees crank angle, cylinders 1 and 6 continue a startup exhaust stroke, cylinder 8 begins a startup exhaust stroke, cylinder 2 begins a normal intake stroke and cylinder 3 begins a special intake stroke, cylinder 7 continues an intake stroke, and cylinder 4 begins a startup combustion and expansion stroke. Additionally, sufficient kinetic energy has accumulated within the engine such that cylinder 5 begins a compression stroke (241-1). When cylinder 5 begins its compression stroke the engine begins its transition from the startup mode to normal operating mode.

At about 360 degrees crank angle, cylinders 1 and 6 begin another intake stroke, cylinder 2 continues an intake stroke, cylinder 3 begins a startup combustion and expansion stroke, cylinder 4 begins a startup exhaust stroke, cylinder 5 continues a compression stroke, cylinder 7 begins a compression stroke (240-1), and cylinder 8 continues its startup exhaust stroke.

At about 450 degrees crank angle, cylinder 1 continues its intake stroke, cylinder 2 begins its compression stroke (240-2), cylinder 3 starts its startup exhaust stroke, cylinder 4 continues its startup exhaust stroke, cylinders 5 and 6 start a combustion and expansion stroke (startup CES 230-6 for cylinder 6, normal combustion and expansion stroke CE4 250 for cylinder 5), cylinder 7 begins a compression stroke and cylinder 8 starts an intake stroke. Note that cylinder 5 is fired following a compression stroke and is thus fired as part of the normal operating mode whereas the firing of cylinder 6 does not follow a compression stroke and is thus fired as part of the startup mode.

At about 540 degrees crank angle, cylinder 1 begins a compression stroke (240-3), cylinder 2 continues a compression stroke, cylinder 3 continues a startup exhaust stroke, cylinder 4 begins an intake stroke, cylinder 5 continues a combustion and expansion stroke, cylinder 6 begins a startup exhaust stroke, cylinder 7 begins a combustion and expansion stroke, and cylinder 8 continues an intake stroke.

At about 630 degrees crank angle, cylinder 1 continues a compression stroke, cylinder 2 begins a combustion and expansion stroke, cylinder 3 begins an intake stroke, cylinder 4 continues an intake stroke, cylinder 5 begins an exhaust stroke, cylinder 6 continues the startup exhaust stroke, cylinder 7 continues a combustion and expansion stroke, and cylinder 8 begins a compression stroke (240-4).

As shown in FIG. 4, there are seven firing intervals in which the start up cycle and normal four-cycle processes overlap. This overlap helps to smooth the transition from start-up mode to normal operation mode. At about 720 degrees crank angle, the control unit 70 begins completely operating the engine in its normal four-stroke operating mode, thus marking the end of the start up mode.

As previously mentioned, in order for the self-starting process to begin, at least one piston within a cylinder must be in the predetermined crankshaft angle range in order to provide it the ability to rotate the crankshaft in the proper direction when the cylinder is fired. Additionally, there should be a fresh charge, rather than combustion residue, entrapped within the cylinders.

In a typical eight-cylinder engine, such as the 351 cubic inch V8 spark ignition engine, the engine will always have two cylinders in the predetermined range. In an engine with four or fewer cylinders, however, it is possible that when the engine stops, none of the pistons will be located within the predetermined range. Accordingly, the control unit may be configured to engage in a controlled braking process which stops the engine such that at least one piston stops within the predetermined CA range, and also provides fresh charge in the corresponding cylinder.

Two factors contribute to stopping an engine: (i) friction work, which is caused by frictional forces within the engine and is largely uncontrollable, and (ii) pumping work, which is the work consumed by cylinders to draw in working media (i.e., fuel and/or air), compress the working media and expel the working media out of the cylinders. During an engine braking process, all the cylinders either compress working media and then expel it out when the pistons move from BDC to TDC (compression stroke), or vacuum working media and then suck new charge inside when the pistons move from TDC to BDC (vacuum stroke). The pumping work contributed from compression stroke of individual cylinder can be adjusted through changing the effective compression ratio of that cylinder, which can be further achieved through manipulating the intake and exhaust valve event parameters (mainly valve timing parameters such as valve event angle), of that cylinder. Similarly the pumping work contributed from vacuum stroke of individual cylinder can also be adjusted by manipulating the intake and exhaust valve event parameters, as will be described in more detail below.

During the engine braking process, a cylinder conducts a compressing stroke and a vacuuming stroke alternatively. To increase the pumping work during a compressing stroke, the cylinder entraps a greater amount of air before the compressing process starts. Similarly, to increase the pumping work during a vacuuming stroke, the cylinder expels a greater amount of air before the vacuuming process starts. Therefore, the cylinder conducts a breathing process during which the cylinder briefly opens its valve (or valves) around TDC and BDC to equalize its pressure to the ambient pressure in order to produce large pumping work in the follow-up strokes. In one embodiment, the all valves in a cylinder (i.e., both intake and exhaust valves) are widely opened (i.e., maximum valve lift) and then closed at around the BDC and TDC to draw air in (at about TDC) or expel air out (at about BDC). In this embodiment, however, the cylinder will likely not be thoroughly scavenged. Scavenging refers to the process of introducing a fresh charge through the intake valve to help expel burned gases through the exhaust valve. By thorough scavenging the cylinders, a fresh charge can be provided within a cylinder, which is necessary to restart the engine.

Figure 5A:
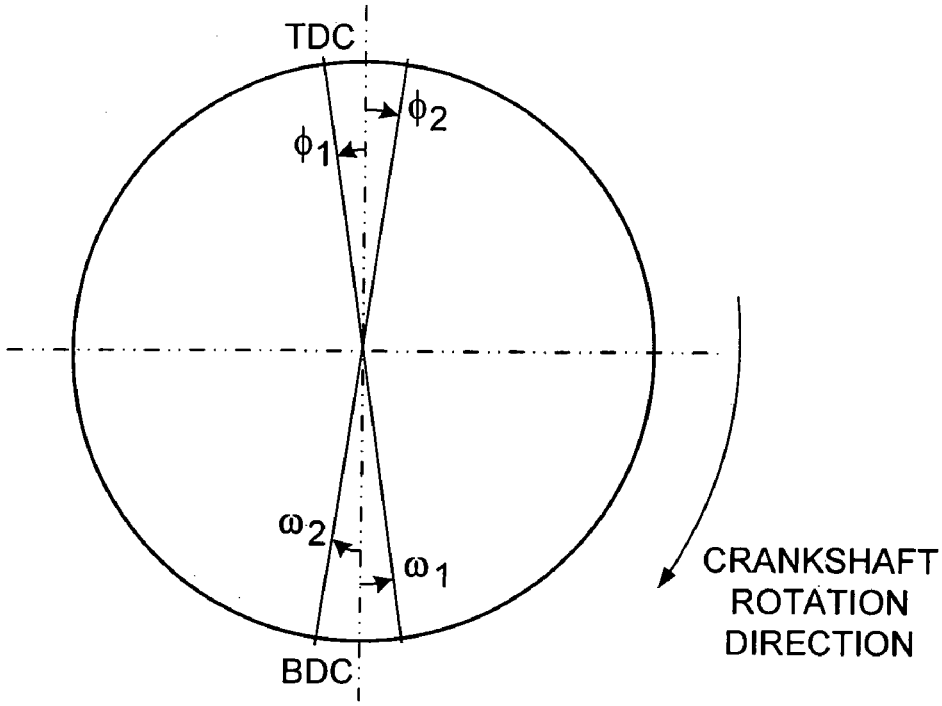
FIG. 5A shows valve timing to produce maximized pumping work within a cylinder.
Figure 5B:
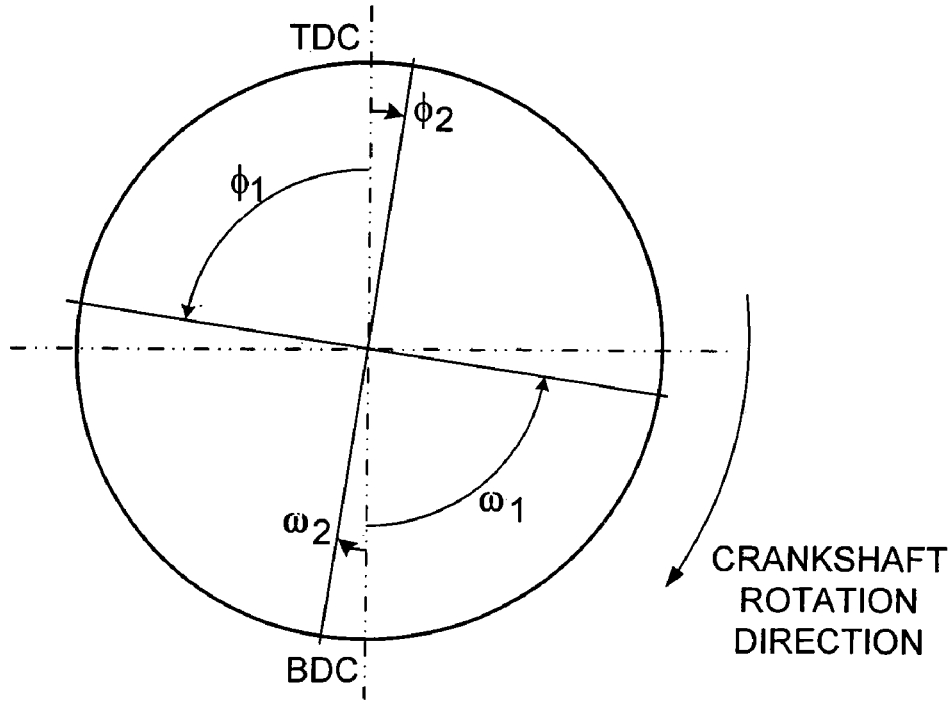
FIG. 5B shows valve timing to produce pumping that is less than a maximized amount of pumping work within a cylinder.
Figure 5C:
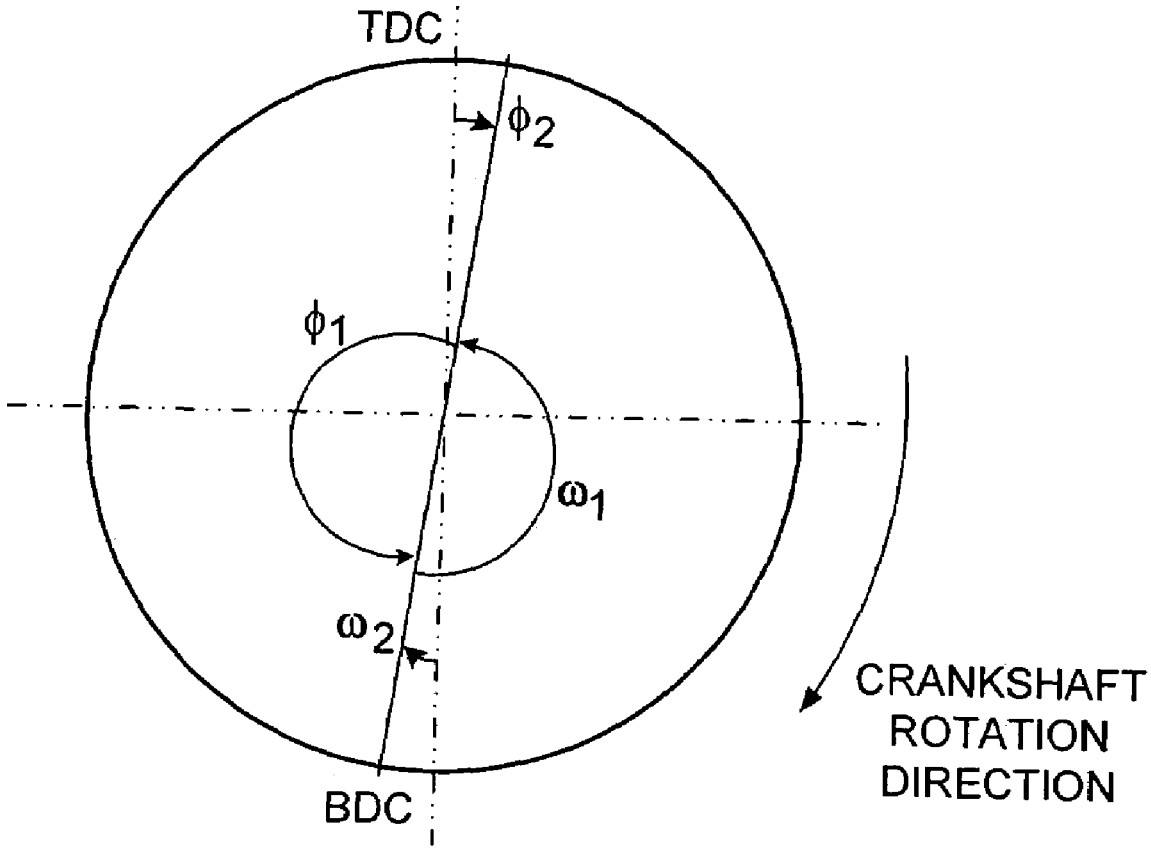
FIG. 5C shows valve timing to produce minimized pumping work within a cylinder.

In another embodiment, illustrated in FIGS. 5A–5C, the intake and exhaust valves are controlled to provide a controlled level of pumping work, while also ensuring a thorough scavenging of the cylinders.

FIG. 5A illustrates valve timing events during the braking process which produce a maximized amount of pumping work while ensuring an adequate scavenging of the cylinder. The exhaust valve of this cylinder is widely (i.e., maximum valve lift) opened just before the piston reaches its TDC, i.e., at $\phi_1$ degree crank angle before TDC, and releases the compressed charge from the last braking stroke to the exhaust system. It should be noted that it is not necessary to always have the maximum valve lift, but the valve lift parameter may be adjusted depending on the desired pumping work and other factors such as the engine speed. The exhaust valve closes shortly after the piston passes its TDC, i.e., at $\phi_2$ degree crank angle after the TDC. Upon closing of the exhaust valve, the cylinder traps a small amount of charge. As the piston moves towards its BDC from TDC, the cylinder is vacuumed and high pumping work is generated until the piston moves close enough to its BDC where the intake valve widely opens, i.e., $\omega_1$ degree crank angle before BDC, to introduce fresh charge from the intake manifold. The intake valve is closed shortly after the piston passes its BDC, i.e., $\omega_2$ degree crank angle after BDC. Upon the intake valve's closing, the cylinder entraps sufficient fresh charge from the intake manifold. As the piston moves back toward its TDC from BDC, the entrapped fresh charge is compressed, thus generating high pumping work.

To decrease the pumping work from a cylinder, the intake valve open advance angle $\phi$1 and the exhaust valve open advance angle $\phi$1 can be increased, as shown in FIG. 5B. At the extreme situation, the intake valve opens right after the exhaust valve closes, and the exhaust valve opens right after the intake valve closes, thus minimizing cylinder pumping work. FIG. 5C illustrates valve timing events which produce minimized amount of pumping work while ensuring adequate scavenging of the cylinder.

Desirable valve event parameters maximizing pumping work while also ensuring an adequate scavenging of the cylinder may vary with the design of the particular engine. Such parameters can be determined through simulation, engine testing, or other techniques known to persons of ordinary skill in the art. For the whole engine, the total amount of pumping work can be controlled through by the pumping work generated by each of the cylinders. It should be noted that it is not necessary to regulate the pumping work generated by every single cylinder.

Figure 6A:
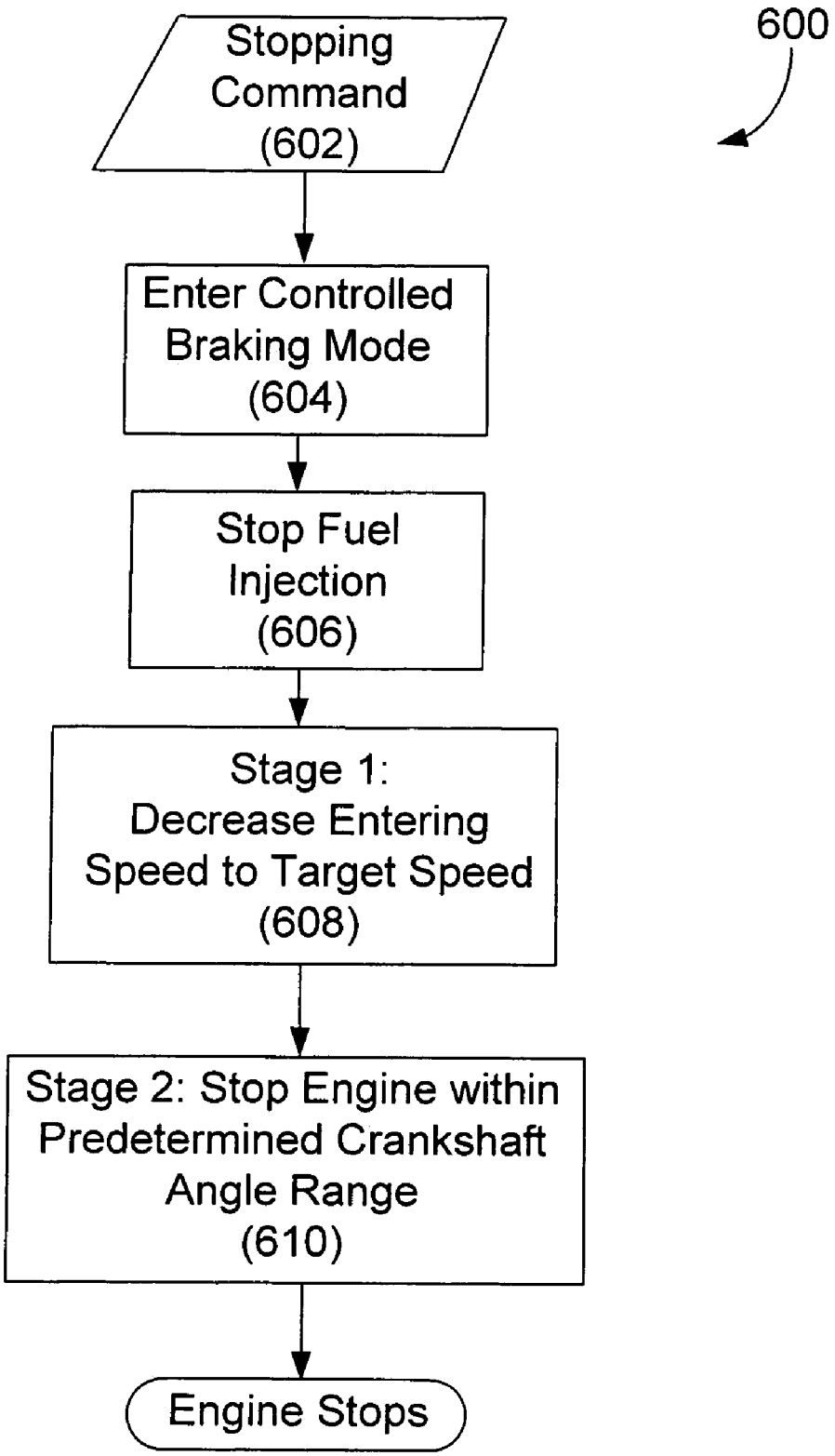
FIG. 6A is a flow chart illustrating a two-stage controlled braking process.
Figure 6B:
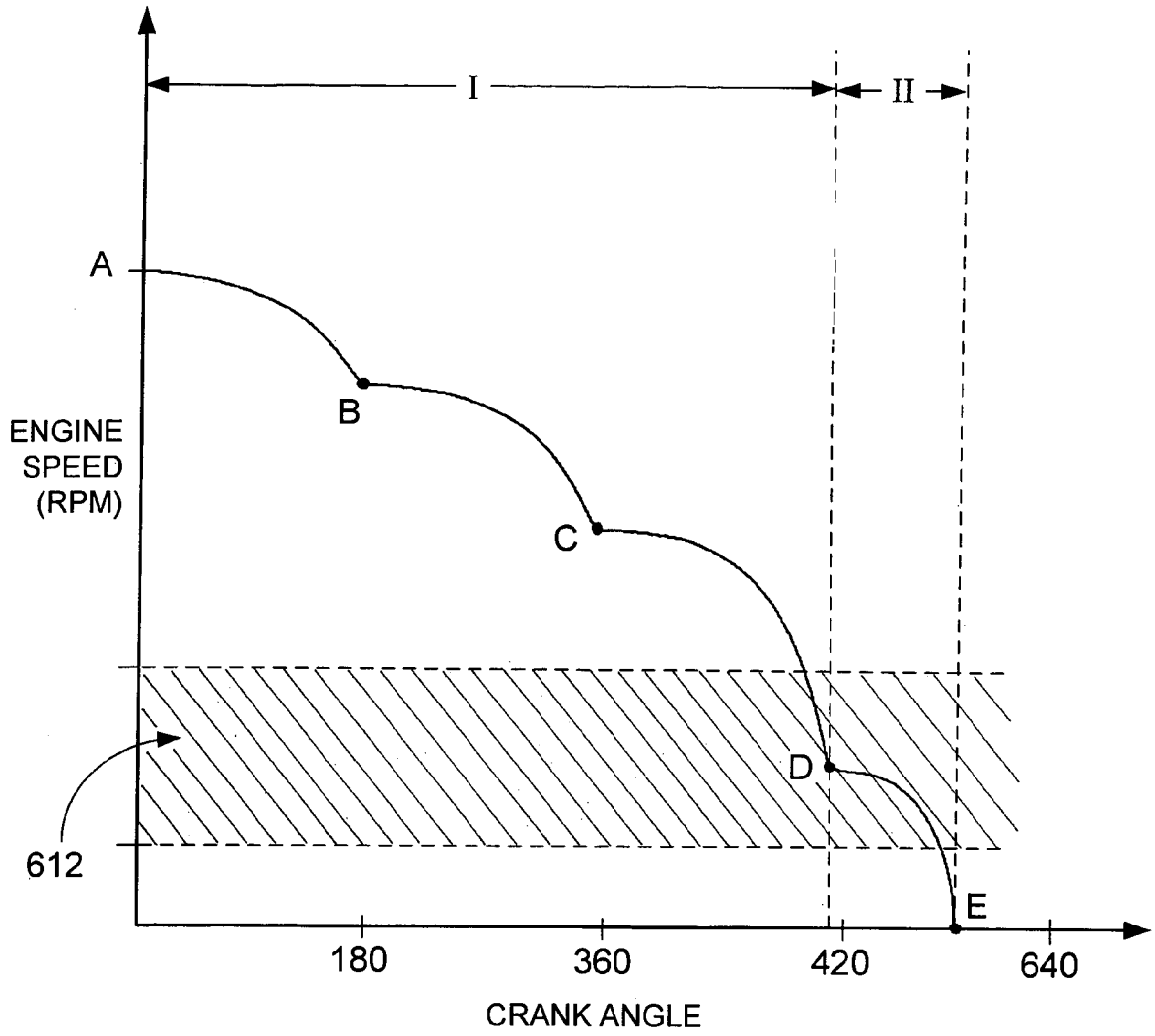
FIG. 6B is a graph illustrating the engine speed versus crankshaft angle during an exemplary application of the controlled braking process shown in FIG. 6A.

As shown in FIG. 6A–6B, a controlled engine braking process 600 uses pumping work adjustment to stop an engine such that at least one of the engine's pistons stops in a predetermined location. As shown in FIG. 6A, a control unit initially receives a command to stop the engine (602) and, in response, the control unit transitions the engine from normal four-stroke operating mode to a controlled braking mode (604).

Upon entering the controlled braking mode, the control unit stops the injection of fuel into the cylinders (606). If fuel-air mixture is within a cylinder before the engine transitions to braking mode, the control unit may ignite this cylinder to combust the mixture and finish the last normal combustion stroke. In one embodiment, cylinders that have already finished their last exhaust stroke enter braking mode immediately and pumping work may be adjusted to these cylinders while other cylinders are still being fired. In another embodiment, the cylinders will enter braking mode after all cylinders finish the last normal combustion stroke. In yet another embodiment, the control unit waits until all cylinders have stopped firing before transitioning the engine from normal four-stroke operating mode to a controlled braking mode.

After entering the braking mode, the control unit enters a first braking stage (608) in which it actuates the valves of one or more cylinders to produce pumping work over one or more braking strokes to decrease the speed of the engine from an entering speed (shown as the speed at point A in FIG. 6B) to a target speed (shown as the speed at point D in FIG. 6B) that is within a range of desired target speeds (shown as the shaded region 612 in FIG. 6B).

The target speed is preferably selected to be at the midpoint within the range of desired target speeds in order to provide for the maximum variance between the target speed and the actual speed after completing the braking strokes of the first stage while maintaining the actual speed within the range of desired target speeds.

The range of desired target speeds is a range of engine speeds for which valve parameters, which have been determined through simulation or actual engine testing, produce sufficient pumping work to stop the engine in a single stroke, so that the engine last stroke (during which the engine stops) angle falls within a range of desired crankshaft angles. The desired range of crankshaft angles are those crankshaft angles which have at least one piston positioned within a predetermined CA range relative to top dead center where the piston has sufficient mechanical advantage to rotate the crankshaft (e.g., 25–155 crankshaft angle degrees after TDC). The upper bound of the target speed range is the greatest entering speed (i.e., the speed of the engine prior to entering the last braking stroke) at which the engine can be stopped within the desire crankshaft range using maximized pumping work. The lower bound of the target speed range is the smallest entering speed at which the engine can be stopped within the desired crankshaft range using minimized pumping work.

To further illustrate the range of desired target speeds, consider an engine where it has been determined through simulation that application of a maximized amount of pumping work to the engine will result in a last stroke angle that falls within a range of desired crankshaft angles when it has an entering speed between 100–500 RPM. Further consider that it has been determined through simulation that application of a minimized amount of pumping work to the engine will result in a last stroke angle that falls within the same range of desired crankshaft angles when the engine has an entering speed of between 50–200 RPM. In this example, the range of desired target speed is between 50–500 RPM since pumping work may be applied at any speed in this range to cause the crankshaft to stop in the desired position. The valve event parameters to produce the amount of pumping work required for this range of engine speeds may be determined dynamically through a closed-form calculation or statically through a look-up table or other data structure in which valve parameters corresponding to different amounts of pumping work have been statically computed and stored in memory. Alternatively valve event parameters may be dynamically adjusted in real-time, based on engine speed monitoring and a predefined feedback control law, to reduce the engine speed.

Referring again to FIG. 6A, during the first stage of braking operation mode (608), the control unit first measures the entering speed of the engine, which is the speed of the engine (e.g., revolutions per minute of the engine) before entering a braking stroke. The control unit then computes the total amount of pumping work required to reduce the engine speed from the entering speed to the target speed. After computing the total amount of pumping work required to reduce the engine speed from the entering speed to the target speed, the control unit determines the number of braking strokes required to decrease the entering speed to a speed within the target speed range. It should be noted that the total amount of pumping work required and the number of braking strokes required also depend on the valve event parameters. For example, if maximum pumping work of each braking stroke is used, the number of braking strokes required will be less than when the minimum pumping work of each braking stroke is used. To minimize the effect of friction variation, the total pumping work is preferably evenly distributed among the determined number of braking strokes. For example, as shown in FIG. 6B, the pumping work required to reduce the engine's speed from the entering speed (i.e., the speed at point A) to the target speed (i.e., the speed at point D) is evenly divided among three braking strokes.

The control unit then determines, based on the computed pumping work required for each one of the three braking strokes, the valve event parameters that produce the desired amount of pumping work to slow the engine during each braking stroke. The determination of the valve event parameters required to produce the computed amount of pumping work may be made through a closed-form calculation computed dynamically or by way of a look-up table in which valve event parameters corresponding to different amounts of pumping work have been pre-computed and stored in memory. Finally the control unit applies the requisite pumping work over the braking strokes to decrease the engine speed to the target speed.

After decreasing the engine speed from an entering speed to the target speed through one or more braking strokes, the controlled engine braking process (600) then enters the second braking stage (610). In the second stage, based on the residual speed from the first braking stage, the control unit controls the valve event parameters to apply the proper amount of pumping work to stop the engine within the range of desired crankshaft angles. The control unit may determine the proper valve event parameters through a valve event parameters map, which maps entering speed to the last stroke angle with various valve event parameters.

Since the engine friction condition may change from time to time, the friction condition can be estimated during the first stage of the braking process so it can be adaptively compensated for. A control unit may be configured to estimate the amount of friction work that is occurring within the engine during the first stage of the braking process based on measured crankshaft speed in response to various valve events and other parameters. The control unit may further be configured to adjust valve event parameters based on the estimated friction work.

In one embodiment, an engine employs a process that adaptively compensates for friction variation in the engine by first predicting the residue speed of a braking stroke based on the entering speed of the braking stroke and expected pumping work during the braking stroke. Then, at the end of the braking stroke, the process compares the actual residual speed to the predicted residual speed to estimate the friction variation, assuming that the deviation between the two is due to an overestimation or underestimation of the friction work present in the cylinders. If the estimated friction work is higher or lower than its normal value, the braking process can adaptively decrease or increase the amount of applied pumping work (by adjusting the valve parameters) during next braking stroke.

In another embodiment, an engine employs a process that adaptively compensates for friction variation in the engine by first applying the minimum pumping work in the very first braking stroke of the first stage of the braking operation mode, so that engine friction dominates that braking stroke. During this braking stroke, the process samples the engine's speeds and derives the engine's acceleration and inertia from the sampled speeds. The engine's friction is then estimated based on the inertia and acceleration of the engine. The estimated engine friction is then compared to a normal friction value, and the pumping work applied to each following braking stroke is adjusted by adjusting the valve parameters to compensate for the friction variation. For example, if the actual friction is lower than the normal value, the process can increase the pumping work for the braking strokes to achieve the expected residual speed.

In yet another embodiment, an engine may employ a process that adjusts for friction variation in the engine by comparing the actual last stroke angle to the predicted last stroke angle, and subsequently adjusting the valve parameters to compensate for the friction variation in the next braking process.

An engine may also be provided with a process that uses stored energy, such as pressure energy of a fluid in a cylinder, to adjust the crank angle of the engine after it stops. This stored energy can be used to push the engine to rotate backward if the last stroke angle is smaller than 180 CA, or forward when the last stroke angle is larger than 180 CA, which makes the engine configuration at TDC or BDC unstable. Thus the process fine-tunes the last stroke angle using this stored energy by either pushing the last stroke angle to within the predetermined range and/or adjusting the last stroke angle to be at or close to an optimal angle.

The self-starting process can be used along with the controlled braking process that sets at least one piston at the predetermined range and provides fresh charge to the corresponding cylinders to prepare for the self-starting process.

A number of embodiments of the invention have been described. Nevertheless, it will be understood that various modifications may be made without departing from the spirit and scope of the invention. For example, while a four-stroke engine having 8 cylinders has generally been described in the preceding embodiment, the various inventive aspects of this disclosure are not limited to a four-stroke engine, but may be applied to other types of multi-stroke engines such as a two-stroke or six-stroke engine having any number of cylinders. Accordingly, other embodiments are within the scope of the following claims.

What is claimed is:

1. A method of starting an internal combustion engine, wherein the engine includes a plurality of cylinders each containing a piston which is mechanically connected to a crankshaft, and wherein the engine is configured to operate with a predefined normal firing order, the method comprising:

selecting at a cylinder for initial firing, selection of the cylinder based upon the piston of the cylinder being located in a predetermined position along its stroke;

injecting fuel into the selected cylinder to create an uncompressed fuel-air mixture;

igniting the uncompressed fuel-air mixture in the selected cylinder;

repeating selecting, injecting and igniting after said initial selecting, injecting and igniting until there is sufficient kinetic energy to complete a compression stroke in at least one of the cylinders, the selecting being made as a function of cylinder piston position without regard to normal firing order; and after completion of a compression stroke, firing the cylinders according to the predefined normal firing order.

2. The method of claim 1 further comprising:

adjusting a dynamic compression ratio of the selected cylinder by adjusting valve event parameters of the selected cylinder prior to firing the cylinder according to the normal firing order.

3. The method of claim 1, wherein the predetermined piston position of the cylinder selected for initial firing is a position where the piston has sufficient mechanical advantage to rotate the crankshaft through at least 180 degrees in response to igniting the mixture in the first selected cylinder.

4. The method of claim 3, wherein the predetermined piston position of the cylinder selected for initial firing is a position selected to have sufficient mechanical advantage to rotate the crankshaft in a counter-clockwise direction.

5. The method of claim 3, wherein the predetermined piston position of the cylinder selected for initial firing is a position selected to have sufficient mechanical advantage to rotate the crankshaft in a clockwise direction.

6. The method of claim 3 wherein the predetermined piston position of the cylinder selected for initial firing is in a range between 25 and 155 crankshaft degrees after top dead center.

7. The method of claim 1, wherein after igniting the cylinder selected for initial firing, the piston of the selected cylinder moves towards bottom dead center.

8. The method of claim 7 further comprising:

opening an exhaust valve when piston moves away from bottom dead center toward top dead center.

9. The method of claim 8, wherein the exhaust valve remains open until the piston reaches approximately top dead center.

10. The method of claim 1 further comprising:

selecting a plurality of cylinders for initial firing, selection of each cylinder based upon the piston of the respective cylinder being located in a predetermined position along its stroke.

11. The method of claim 1 further comprising:

prior to firing the cylinder selected for initial firing, closing an intake valve.

12. The method of claim 11 further comprising:

prior to firing the cylinder selected for initial firing, closing an exhaust valve.

13. The method of claim 1, wherein the fuel is injected to form a combustible mixture with a fuel/air ratio approximately stoichiometric.

14. The method of claim 1, wherein the fuel is injected via direct injection into the selected cylinder from an associated injector.

15. The method of claim 1, wherein the engine is configured to normally operate on a four-stroke combustion cycle.

16. The method of claim 1 further comprising:

before igniting the uncompressed fuel-air mixture in a selected cylinder, opening an intake valve to introduce a fresh charge into the selected cylinder.

17. The method of claim 1 wherein said selecting, injecting and igniting occurs while the cylinders are fired according to the predefined normal firing order.

18. An internal combustion engine comprising:

a plurality of cylinders, each housing a piston attached to a crankshaft;

an intake valve that controls the intake of air into the cylinder;

an exhaust valve that controls the expulsion of air from the cylinder;

an intake valve actuator that controls operation of the intake valve;

an exhaust valve actuator that controls operation of the exhaust valve; and a starting module that identifies at least one cylinder with piston in a predetermined position range, selects the identified cylinder independently of the normal operating stroke cycles, and fires the identified cylinder, wherein the starting module is configured to start the engine selectively in either forward or reverse.

19. A method of starting a four-stroke internal combustion engine from rest, wherein the engine includes a plurality of cylinders each containing a piston, the method comprising:

operating a first number of the plurality of cylinders in a two-stroke cycle that does not compress fuel-air mixture prior to combustion; and after sufficient kinetic energy has accumulated in the engine to complete a compression stroke, then operating simultaneously with the first number a second number of the plurality of cylinders in a normal four-stroke cycle.

20. The method of claim 19 further comprising:

ceasing operation of a first number of cylinders in the two-stroke cycle while continuing operation of a second number of cylinders in a normal four-stroke cycle.

21. The method of claim 19 wherein the two stroke cycle includes a first stroke that introduces a fresh charge and a second stroke that releases combustion residue.

* * * * *